US009314789B2

(12) United States Patent
Bernay et al.

(10) Patent No.: US 9,314,789 B2
(45) Date of Patent: Apr. 19, 2016

(54) RECEPTACLE OF GEL CARD TYPE EQUIPPED WITH A LID COMPRISING A PRECUT

(75) Inventors: Sébastien Bernay, Ecoche (FR); Jean-Michel Brisebrat, Villers (FR); Frédéric Buffiere, Pessac (FR)

(73) Assignees: DIAMED GMBH, Cressier (CH); BIO-RAD INNOVATIONS, Marnes la Coquette (FR)

( * ) Notice: Subject to any disclaimer, the term of this patent is extended or adjusted under 35 U.S.C. 154(b) by 0 days.

(21) Appl. No.: 14/004,129

(22) PCT Filed: Mar. 9, 2012

(86) PCT No.: PCT/FR2012/050506

§ 371 (c)(1), (2), (4) Date: Dec. 16, 2013

(87) PCT Pub. No.: WO2012/120247

PCT Pub. Date: Sep. 13, 2012

(65) Prior Publication Data

US 2014/0124510 A1 May 8, 2014

(30) Foreign Application Priority Data

Mar. 10, 2011 (FR) ..... 11 51979

(51) Int. Cl.
*B01L 3/14* (2006.01)
*B01L 3/00* (2006.01)
(Continued)

(52) U.S. Cl.
CPC ..... *B01L 3/14* (2013.01); *B01L 3/50853* (2013.01); *B65B 69/00* (2013.01);
(Continued)

(58) Field of Classification Search
CPC ..... B65D 1/36; B65D 25/04; B65D 17/502; B65D 17/501; B29C 65/18; B29C 65/02; B65B 7/2878; B65B 7/2871; B65B 7/2842; B65B 7/28; B65B 69/00; B65B 69/0066; B01L 3/14; B01L 3/50853; Y10T 29/49
USPC ..... 220/526, 524, 523, 507, 359.2, 359.4, 220/359.1; 53/492, 381.1, 467, 477, 478, 53/476
See application file for complete search history.

(56) References Cited

U.S. PATENT DOCUMENTS 3,703,955 A * 11/1972 Inacker ..... 206/532
4,253,572 A * 3/1981 Halbich ..... 206/538
(Continued)

FOREIGN PATENT DOCUMENTS

DE 38 29 249 A1 3/1990
DE 102 52 572 A1 5/2004
(Continued)

OTHER PUBLICATIONS

Translation of DE10252572 (Kaiser et al.), May 19, 2004, Paragraphs 21 and 22.*
(Continued)

*Primary Examiner* — Robert J Hicks
(74) *Attorney, Agent, or Firm* — Bookoff McAndrews, PLLC

(57) ABSTRACT

Receptacle of gel card type comprising a body, formed in which are several adjacent wells, initially sealed by a cover having a length and a width. The cover has at least one precut between two adjacent wells so as to form at least one cover portion sealing at least one of the wells of the receptacle.

13 Claims, 6 Drawing Sheets

(51) Int. Cl.
*B65B 69/00* (2006.01)
*B65D 17/50* (2006.01)

(52) U.S. Cl.
CPC .... *B65B 69/0066* (2013.01); *B01L 2200/0689* (2013.01); *B01L 2200/12* (2013.01); *B01L 2300/041* (2013.01); *B01L 2300/069* (2013.01); *B01L 2300/0816* (2013.01); *B01L 2300/0829* (2013.01); *B65D 17/501* (2013.01); *Y10T 29/49* (2015.01)

(56) References Cited

U.S. PATENT DOCUMENTS

| | | | | |
|---|---|---|---|---|
| 5,409,127 | A * | 4/1995 | Stratford et al. | 220/23.4 |
| 7,121,410 | B2 * | 10/2006 | Rohrmus et al. | 206/531 |
| 2002/0166790 | A1 * | 11/2002 | Aylward | 206/531 |
| 2005/0160704 | A1 | 7/2005 | Miksch | |
| 2006/0188404 | A1 | 8/2006 | Gjerde | |
| 2007/0215276 | A1 * | 9/2007 | Sieredzinski | 156/344 |
| 2007/0257035 | A1 | 11/2007 | Berndt et al. | |
| 2008/0245800 | A1 * | 10/2008 | Moore | 220/507 |
| 2012/0051975 | A1 | 3/2012 | Buffiere et al. | |

FOREIGN PATENT DOCUMENTS

| | | | |
|---|---|---|---|
| DE | 10 2006 005 700 | A1 | 8/2007 |
| DE | 10 2008 046 668 | A1 | 3/2010 |
| FR | 2 267 753 | | 11/1975 |
| FR | 2 409 916 | | 6/1979 |
| WO | WO 03/062508 | A1 | 7/2003 |
| WO | WO 2010/116069 | A2 | 10/2010 |

OTHER PUBLICATIONS

International Search Report for corresponding International Application No. PCT/FR2012/050506, mailed on Jun. 6, 2012, 5 pages.
My Contact Lens, "My Contact Lenses: blister packing", May 30, 2008, 2 pages, (https://mycontactlens.wordpress.com/2008/05/30/blister-packing/).
My Contact Lens, "My Contact Lenses: saline on a blister pack", May 30, 2008, 2 pages, (https://mycontactlens.wordpress.com/2008/05/30/saline-on-a-blister-pack/).

* cited by examiner

RECEPTACLE OF GEL CARD TYPE EQUIPPED WITH A LID COMPRISING A PRECUT

CROSS-REFERENCE TO RELATED APPLICATIONS

This application is a National Stage filing under 35 U.S.C. §371 of International Application No. PCT/FR2012/050506, filed Mar. 9, 2012, which claims priority to French Patent Application No. FR1151979, filed Mar. 10, 2011, the contents of each of which are incorporated by reference herein.

FIELD OF THE INVENTION

The present invention relates to the field of apparatuses for performing biological or medical analyses.

BACKGROUND OF THE INVENTION

Traditionally, such apparatuses, also called automated analyzer, make it possible to automate certain protocols, for example such as the distribution of liquids in gel cards. This protocol consists of pouring a predetermined quantity of liquid using a liquid distributing device into a reaction well of a gel card generally containing one or more reagents. This liquid may for example be a blood sample, or any other type of human sample.

In a known manner, a gel card is a receptacle including a body in which one or more reaction wells are formed in which the biological reactions take place.

Traditionally, the wells of the gel card are initially covered by a cover that is sealed to the body. Most often, this cover is made up of a thin strip of aluminum.

Generally, the operation for distributing liquids in the reaction wells is carried out by piercing the cover using a liquid distribution device provided with a needle so as to open one or more wells. Next, the liquid is poured into the well(s) using that same needle.

One drawback is that repeating the metal cover piercing operation destroys the tips of the needles. The latter must therefore be disassembled and changed regularly, which represents a non-negligible cost and furthermore requires stopping the machine.

Another drawback appears during the use of gel cards having non-identical reaction wells, i.e., containing different reagents. In that case, it is generally necessary to wash the needles between each liquid distribution so as to avoid contamination between the wells of said gel card. By passing through the cover in order to open a first well containing the first reagent, the needle may be soiled by droplets of first reagent that may be attached on an inner face of the cover. If the needle is not rinsed, it risks transporting the first reagent into a second well containing a second reagent different from the first reagent, and causing contamination of the second reagent.

BRIEF DESCRIPTION OF THE INVENTION

One aim of the present invention is to resolve these drawbacks by proposing a receptacle and a solution for opening the wells of said receptacle without piercing the cover thereof.

The present invention first relates to a receptacle of the gel card type comprising a body in which several adjacent wells are formed, which are initially sealed by a cover having a length and a width, wherein the cover has at least one precut between two adjacent wells so as to form a least one cover portion sealing at least one of the wells of the receptacle.

This precut may be formed in the cover before it is sealed to the body of the receptacle, or afterwards, using a suitable cutting machine, for example equipped with one or more coaxial circular saws positioned perpendicularly relative to the plane of the blade.

Furthermore, it will be understood that owing to the receptacle according to the invention, it is possible to open one of the wells of the receptacle easily by removing the cover portion that covers that well.

Subsequently, after opening that well, the liquid distribution needle may be inserted therein so as to pour the liquid into the well. Thus, the invention makes it possible to do away with the step for piercing the cover, which makes it possible to do away with the damage to the end of the needle of the liquid distribution device. Furthermore, inasmuch as the cover portion has been removed, the aforementioned risk of contamination is avoided, owing to which the washing operation between each liquid distribution may advantageously be eliminated or at the very least done less frequently.

Preferably, the body of the receptacle is made from plastic and the cover is sealed to the bodies using a heat-sealing film or glue. In other words, the cover is preferably heat sealed or hot-die sealed to the body of the receptacle.

Preferably, the cover has a precut between each well such that each well is covered by a cover portion.

Thus, owing to the invention, it is possible to choose the wells that one wishes to open, simply by removing the cover portions covering the wells to be opened, this removal being facilitated by the presence of the precuts.

Advantageously, said precut is a continuous notch extending over all or part of the width of the cover.

According to one alternative, said precut is a broken notch extending over all or part of the width of the cover.

Preferably, but not necessarily, said cover portion further includes at least one tongue extending transversely relative to the length of the cover. This tongue makes it possible to help the operator grip the cover portion so as to remove it manually.

The invention next relates to a method for manufacturing a receptacle according to the invention, in which method:

- a receptacle of the gel card type is provided including a body in which several adjacent wells are formed that are initially sealed by a cover having a length and width;
- at least one precut is made in the cover between two adjacent wells, so as to form at least one cover portion sealing at least one of the wells of the receptacle.

Advantageously, the width of the cover is greater than the width of the body of the receptacle, such that the cover portion has at least one tongue, extending transversely relative to the length of the cover.

The present invention further relates to an uncovering station for uncovering a receptacle according to the invention including a body in which several adjacent wells are formed that are initially sealed by a precut cover. It is specified that this uncovering station is first and foremost, but not necessarily, intended to be used with an analysis machine, the receptacles then preferably being gel cards.

According to the invention, the uncovering station includes at least one heating gripping device that is arranged to heat and remove said cover portion.

Firstly, one can see that this uncovering station is particularly compact inasmuch as it does not have means for producing said cover portion.

It will be understood that the heat given off by the gripping device makes it possible to unglue or unweld the cover portion initially sealed to the body of the receptacle, in particular when said cover portion is initially heat-sealed, thermo-fused or simply glued to the body of the receptacle, by melting the heat-sealing film or the glue positioned between the cover and the body of the receptacle. After the heating step, or concomitantly therewith, the gripping device removes a portion of the cover from the body, for example by peeling it.

The heating gripping device makes it possible to melt this heat-sealing film or this glue, for example by applying a temperature of approximately 200° C. for a long enough length of time to obtain melting.

The heat transfer between the heating gripping device and the plastic material is ensured owing to the conductive properties of the component material of the cover, which is preferably metal.

After the cover portion is removed by the gripping device, the selected well that was initially covered by said cover portion is open. Furthermore, the rest of the cover remains sealed to the body of the receptacle while covering the non-selected wells.

Preferably, the gripping device comes into contact with the cover while exerting a predetermined pressure thereon for a predetermined length of time, so as to ensure good homogeneity of the heat transfer.

Hereafter, it will be understood that one major interest of the facility lies in allowing the selective opening of one or more wells, i.e., the reaction wells one wishes to use (the selected wells), the other wells advantageously remaining covered for a future reuse of the receptacle, and in order to avoid drying of the open reaction wells not intended to be used.

Furthermore, the invention makes it possible to open one or more wells that are not necessarily adjacent.

Preferably, but not necessarily, the wells of the receptacle are aligned in a single row.

Advantageously, the station according to the invention includes a plurality of gripping devices that can be moved independently of one another, each of the gripping devices having an idle position in which said gripping device is heated by a heating device, and a working position in which said heating gripping device is brought to bear against the or one of the cover portion(s).

Thus, the invention makes it possible to remove several cover portions at once, i.e., to open several selected wells in a single operation, said wells not necessarily being adjacent.

Preferably, but not exclusively, as many gripping devices are provided as there are wells in the receptacle.

Furthermore, the station advantageously includes a selection mechanism for selecting the gripping device(s) needing to be moved toward the working position, and a movement device for moving said selected gripping device(s) toward the working position.

According to one preferred embodiment, the selection mechanism is arranged so as not to allow the movement of the gripping devices associated with the wells that are not selected, i.e., that are not designed to be opened.

For example, the movement device includes a plate, each gripping device is fastened to the plate using a spring designed to exert a pressure force on the gripping device oriented toward the body of the receptacle, and the selection mechanism is arranged to prevent the movement, for example vertical movement, of the gripping devices that are not selected.

Advantageously, the heating device includes a fixed heating baseplate and, in the idle position, each gripping device is in contact with said heating baseplate.

It will therefore be understood that each heating gripping device is heated by the heating baseplate when said device is in the idle position. One interest lies in keeping the gripping devices at a sufficient temperature to allow ungluing of the cover portions, in particular the gripping devices that are not used for several well opening sequences.

Such an arrangement in particular makes it possible to avoid the downtime resulting from the heating time of the gripping devices not in use and thereby improves the efficacy of the uncovering station.

Preferably, each gripping device comprises means for gripping one of the cover portions, and the station furthermore includes at least one discharge member for expelling said cover portion gripped by the gripping device. One interest of these means lies in avoiding the flash resulting from melting the thermoplastic welding material, which may form plastic threads connected to the cover portion that would solidify again upon removal of said cover portion.

It will therefore be understood that the means for gripping one of the cover portions make it possible to facilitate the removal of said cover portion. Said means make it possible to perform a vertical removal during the raising of the gripping device or to facilitate the removal operation by peeling through transverse movements of the receptacle relative to the gripping devices.

Preferably, the discharge member includes a rod, preferably stationary, around which the gripping device slides, said rod being arranged to expel the cover portion when the gripping device is returned to the idle position. Another function of the rod is to guide the movement of the gripping device.

Thus, when the gripping device is in the working position, the rod is preferably housed in the gripping device so as not to touch the cover portion. However, after the cover removal operation, when the gripping device is returned to the idle position, the latter generally takes the cover portion with it. The rod then protrudes outside the gripping device so as to free the cover portion.

According to another aspect of the invention, the uncovering station further includes means for verifying whether the selected well has been correctly opened.

To that end, sensors are provided, such as optical sensors, preferably one per well.

Furthermore, the station advantageously includes an ionizer to ionize the selected well(s) after opening thereof. The ionization of the wells makes it possible to eliminate the electrostatic charges contained in the wells that are generally the source of the appearance of liquid droplets on the inner surface of the wells.

The invention also relates to a biological sample analysis installation including an uncovering station according to the invention that is designed to uncover the gel cards including reaction wells.

The present invention lastly relates to a method for uncovering a receptacle according to the invention including a body in which several adjacent wells initially sealed by a precut cover are formed, in which:

the cover portion is heated so as to be unglued from the body;

the cover portion is removed from the body, the selected well being thereby opened.

Preferably, the wells are initially heat-sealed by the cover. The cover is preferably glued or thermo-fused to the body of the receptacle.

This method is advantageously carried out by using the uncovering station according to the invention.

BRIEF DESCRIPTION OF THE DRAWINGS

The invention will be better understood, and the advantages thereof will better appear, upon reading the following detailed description of one embodiment shown as a non-limitative example. The description refers to the drawings, in which.

DETAILED DESCRIPTION OF THE INVENTION

Figure 1:
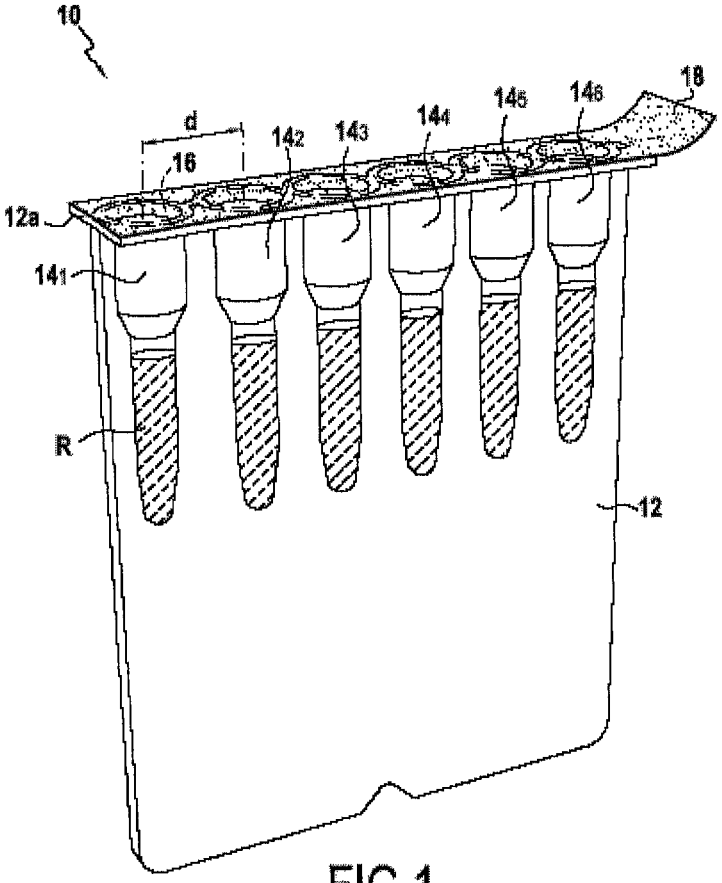
FIG.1 PRIOR ART
FIG. 1 shows a receptacle of the prior art, namely an empty gel card including six reaction wells aligned in a single row.

The receptacle 10 shown in FIG. 1 includes, in a known manner, a plastic body 12 in which several reaction wells 14 are formed, in this case six wells referenced $\mathbf{14}_1$ to $\mathbf{14}_6$, which are adjacent and positioned in a single row. Each of the wells contains a reagent R that may be identical to or different from the reagent contained in the neighboring well. Such a receptacle is well known and is generally called a "gel card".

In reference to FIG. 1, one can see that the wells 14 emerge in an upper wall 12*a* of the gel card. These wells 14 therefore have openings 16 formed in the upper wall 12*a* of the gel card, said openings 16 initially being covered by a cover 18 consisting of a thin strip of aluminum that is sealed to the upper wall 12*a* of the body 12 of the gel card 10, for example using a heat-sealing film or a glue. The distance d between wells corresponds to the distance between the axes of symmetry of two adjacent wells.

As shown in this FIG. 1, the thickness of the gel card 10 is substantially smaller than its other two dimensions.

Receptacles 410, 510, 610 and 710 of the gel card type according to the present invention will now be described in light of FIGS. 2 to 5. Each of these receptacles of the gel card type includes a body 412, 512, 612, 712 and a plurality of wells $\mathbf{414}_1$ to $\mathbf{414}_5$, $\mathbf{514}_1$ to $\mathbf{514}_5$, $\mathbf{614}_1$ to $\mathbf{614}_5$, $\mathbf{714}_1$ to $\mathbf{714}_5$ sealed by a cover 418, 518, 618 and 718.

According to the invention, the covers 418, 518, 618 and 718 of these receptacles 410, 510, 610 and 710 have at least one precut 450, 550, 650 and 750 situated between two adjacent wells so as to form at least one cover portion 418*a* to 418*f*, 518*a* to 518*f*, 618*a* to 618*f*, 718*a* to 718*f* sealing at least one of the wells $\mathbf{414}_1$ to $\mathbf{414}_5$, $\mathbf{514}_1$ to $\mathbf{514}_5$, $\mathbf{614}_1$ to $\mathbf{614}_5$, $\mathbf{714}_1$ to $\mathbf{714}_5$ of the receptacle.

In the examples illustrated here, for each gel card 410, 510, 610 and 710, there is a precut 450, 550, 650 and 750 between each of the wells. There are therefore an equal number of cover portions and wells.

Each well is therefore sealed by a cover portion. Furthermore, it will be understood that these precuts facilitate the removal of the cover portions. Additionally, they make it possible to choose the wells that one wishes to open, i.e., the "selected" wells, the others remaining sealed. To that end, it suffices to remove the cover portions from the wells one wishes to open.

Furthermore, in these examples, the precuts extend over the entire width of the cover.

Figure 2:
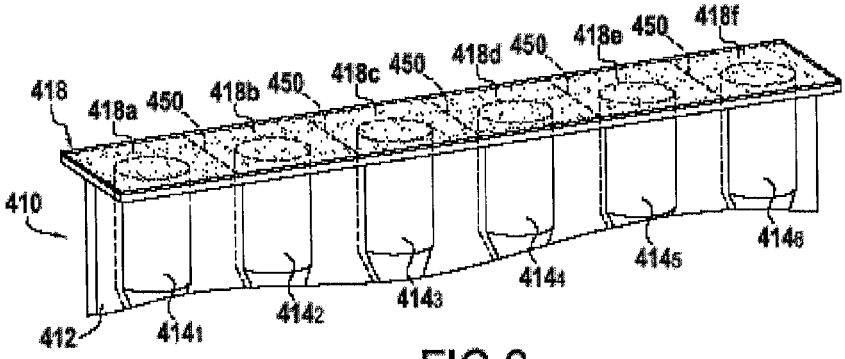
FIG. 2 shows the upper part of a receptacle according to a first embodiment of the invention.
Figure 3:
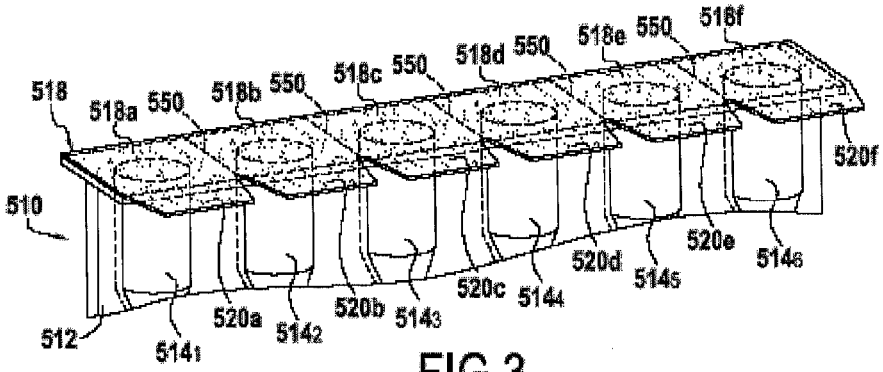
FIG. 3 illustrates an alternative of the receptacle of FIG. 2 where the cover portions are provided with tongues.

According to a first embodiment of the invention, shown in FIGS. 2 and 3, the precuts 450, 550 are made up of a series of small adjacent holes. This forms a broken notch here extending over the entire width of the cover. Without going beyond the scope of the invention, the notch could be made over part of the width of the cover, for example half.

Preferably, the precuts are formed of the cover 518, 618 before the latter is sealed on the body 512, 612 of the receptacle. These precuts locally weaken the cover such that each cover portion can easily detach from the rest of the cover 518, 618. Consequently, the precuts facilitate the removal of the cover portions from the body of the receptacle.

To make the manual removal of the cover portions and opening of the wells even easier, the cover portions may advantageously be provided with tongues 520*a* to 520*f*, as shown in FIG. 3, which shows an alternative of the first embodiment of the receptacle according to the invention. Preferably, the tongues 520*a* to 520*f* extend transversely relative to the body of the receptacle 510, over a length in this example substantially corresponding to half of the width of the upper wall of the receptacle. Of course, these tongues are not necessary when the receptacle is used in a machine.

Figure 4:
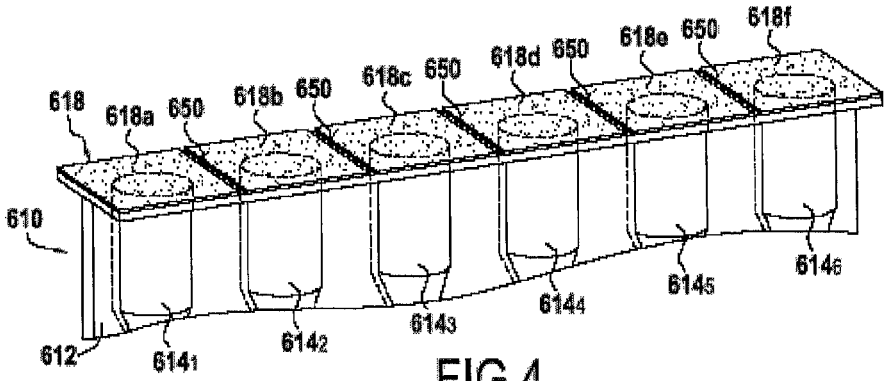
FIG. 4 shows the upper part of a receptacle according to a second embodiment of the invention.
Figure 5:
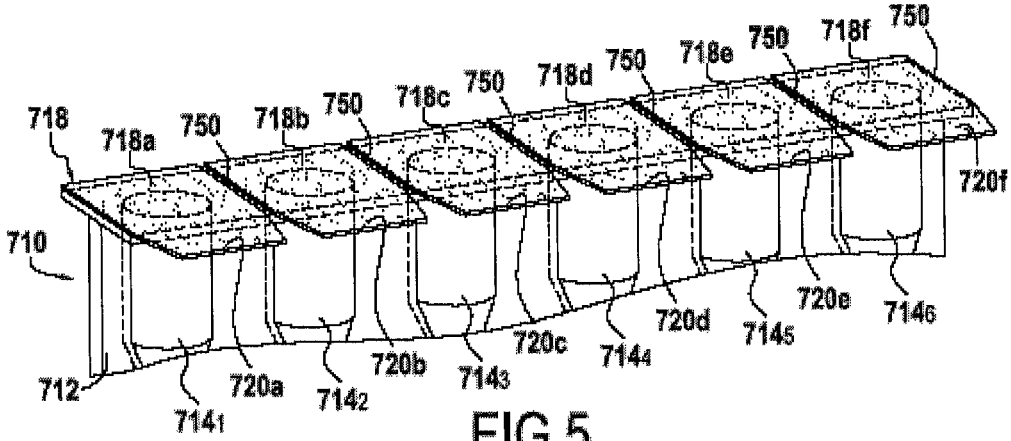
FIG. 5 illustrates an alternative of the receptacle of FIG. 4 where the cover portions are provided with tongues.

According to a second embodiment of the invention, shown in FIGS. 4 and 5, the precuts are formed by continuous notches 650, 750 that extend over the entire width of the cover. Without going beyond the scope of the invention, the notch could be formed over part of the width of the cover, for example half. In this embodiment, the removal of the cover portions is easier insofar as the cover portions are maintained little or not at all by the rest of the cover.

Preferably, the precuts are formed after the cover has been sealed to the body of the receptacle.

In this example, the cover portions 618*a* to 618*f*, 718*a* to 718*f* are well separated from each other, which facilitates the removal of the cover portions and, consequently, the opening of the wells one has chosen to open.

According to one alternative shown in FIG. 5, each of the cover portions includes a tongue 720*a*, 720*b*, 720*c*, 720*d* and 720*e* that extends transversely relative to the length of the cover 718, these tongues here being similar to those of the alternative of the first embodiment. They are interesting when an operator is called upon to open the wells of the receptacle manually.

To manufacture the receptacle according to the invention, the receptacle of the gel card type of FIG. 1 is for example provided, then one or more precuts are made in the cover between two adjacent wells, so as to form at least one cover portion sealing at least one of the wells of the receptacle. By using several coaxial and adjacent circular saws for example, the receptacles 610, 710 of FIGS. 4 and 5 are obtained. The tongues can be obtained starting from a receptacle provided with a cover whereof the width is strictly greater than the length of the body of the receptacle, and making the precut extend over the entire width of the cover.

The receptacles 410, 510 of FIGS. 2 and 3 are preferably, but not necessarily, manufactured by forming the precut in the cover before the latter is sealed on the body of the receptacle. For example, a punch may be used to produce the series of small holes forming the precut. The tongues of FIG. 3 may be obtained by using a cover whereof the width is greater than that of the body of the receptacle and producing a continuous notch in the part of the cover that extends outside the body of the receptacle.

An uncovering station 100 according to the invention will be described in light of FIGS. 6 to 10 that is designed to open one or more of the wells 414 of one of the other of the gel cards 410, 510, 610, 710 previously described. In the continuation of the description, for simplicity reasons, we will describe the uncovering station 100 in reference to the gel card 410 of the first embodiment of the invention. Of course, the other gel cards described above may be used with the uncovering station 100. In this example, the cover, and more generally the cover portions, are heat-sealed to the receptacle, for example using glue or an adhesive film. We will also describe an uncovering method, also according to the invention, carried out by the station 100.

In this example, the uncovering station 100 includes a housing 102 from which two horizontal arms 104 extend. Each of said two arms is provided with a longitudinal slot 106, the two slots 106 being designed to receive the edges of an intake tray 108. In reference to FIG. 6, it will be understood that the intake tray 108 can slide in a horizontal plane while being guided in translation by the slots 106.

Figure 6:
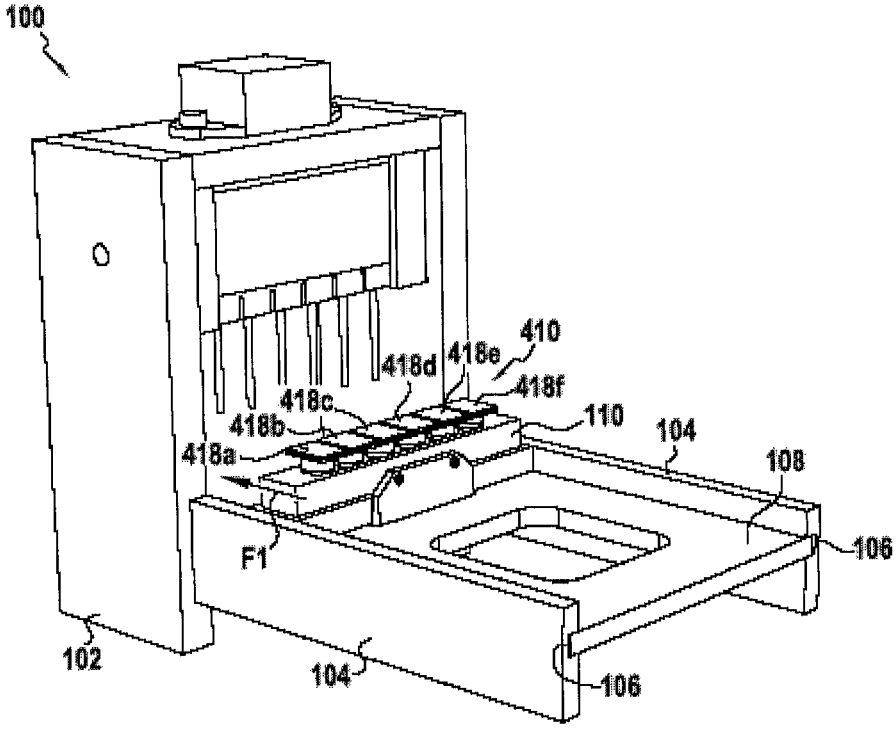
FIG. 6 is a perspective view of an uncovering station according to the invention.

FIG. 6 corresponds to a moment where, the empty gel card 410 having previously been inserted into the recess 110, one begins to move the tray 108 horizontally toward the housing 102, in the direction symbolized by the arrow F1.

One of the ends of the intake tray 108 comprises a recess 110 designed to receive a receptacle, and in particular the gel card 410 of FIG. 2. More specifically, the gel card 410 is positioned in the recess 110 such that the upper wall 412*a* and the cover 418 emerge above the horizontal plane of the intake tray 108.

Figure 7:
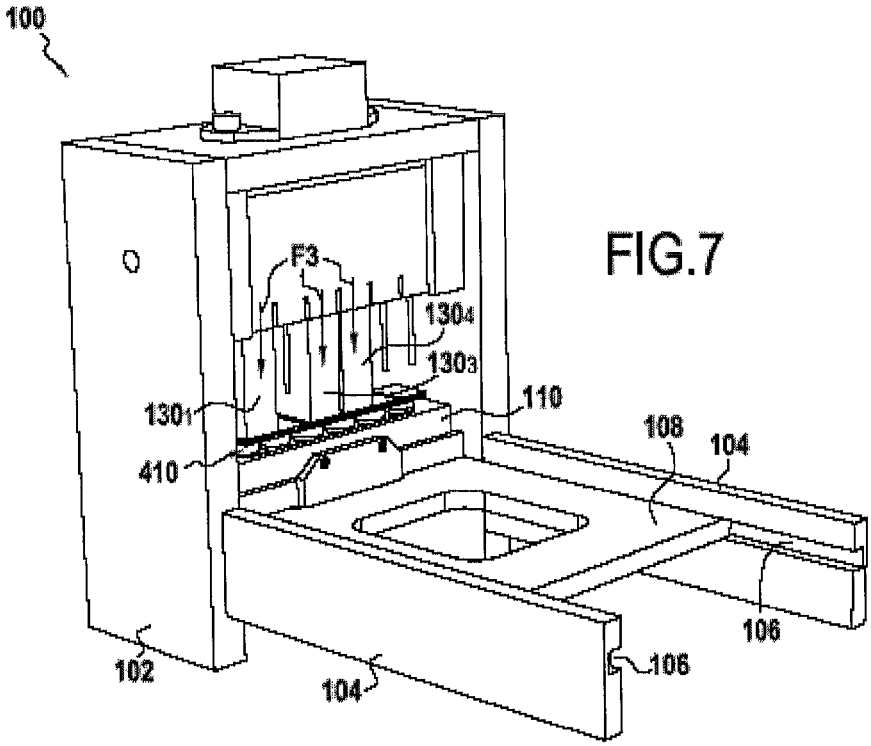
FIG. 7 illustrates the uncovering station of FIG. 6, where three gripping devices are brought into the working position so as to heat the three cover portions covering the three selected wells.
Figure 8:
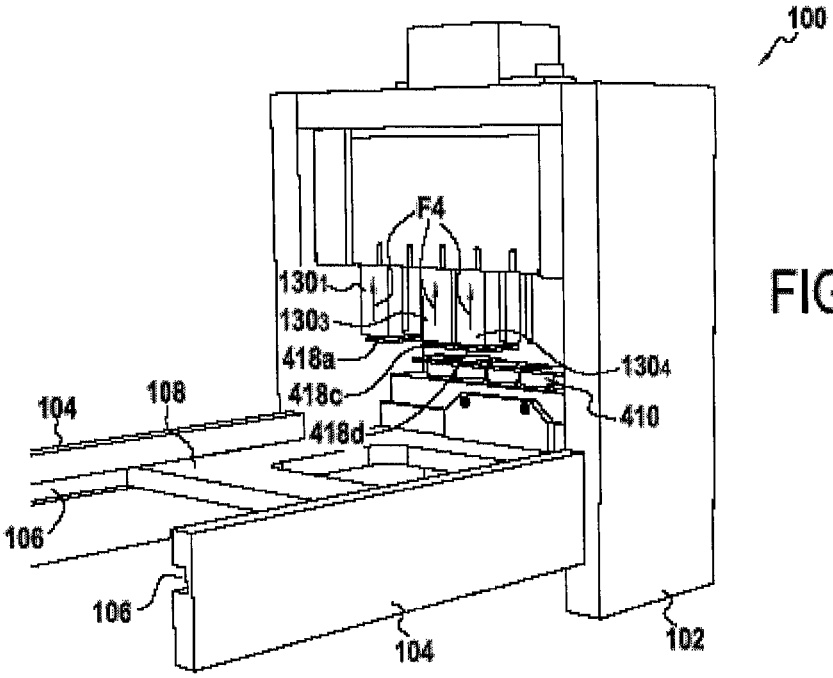
FIG. 8 illustrates the opening of the three selected wells.
Figure 9:
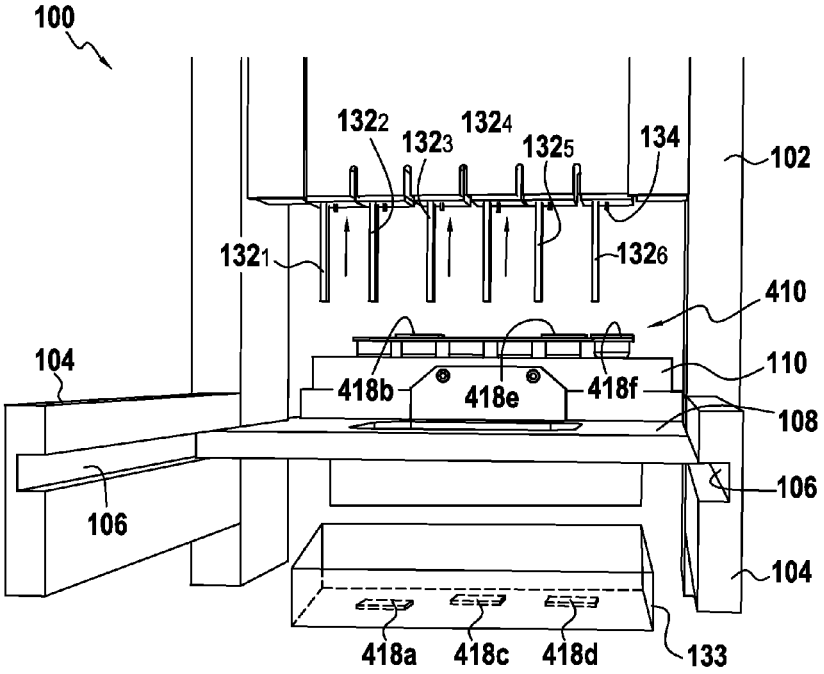
FIG. 9 illustrates the raising of the three gripping devices and the removal of the three cover portions.
Figure 10:
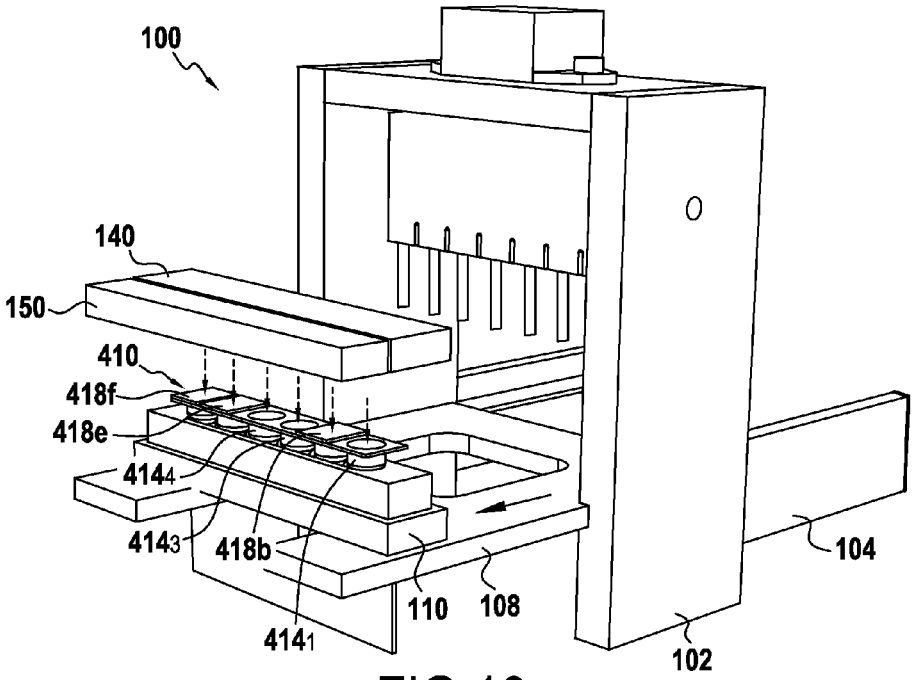
FIG. 10 illustrates the step during which it is verified that the selected wells have been correctly opened.

FIGS. 7 and 8 will now be used to describe how the uncovering operation is carried out.

In this example, a decision is made to open the wells $\mathbf{414}_1$, $\mathbf{414}_3$ and $\mathbf{414}_4$. This choice is completely arbitrary and, of course, it may be decided to open only one of the wells or any other combination of wells.

The wells $\mathbf{414}_1$, $\mathbf{414}_3$ and $\mathbf{414}_4$ that one wishes to open are called the selected wells. These selected wells $\mathbf{414}_1$, $\mathbf{414}_3$ and $\mathbf{414}_4$ are therefore covered by the cover portions referenced $\mathbf{418}_a$, $\mathbf{418}_c$ and $\mathbf{418}_d$.

According to the invention, the uncovering station 100 includes a plurality of heating gripping devices 130, each of said devices being arranged to heat and remove a cover portion. It is thus possible to heat and remove the cover portion in a single operation.

In this example, the heating gripping devices assume the form of studs that can be moved vertically, independently of one another, but not necessarily simultaneously. In the case at hand, the station includes six studs that are positioned across from each of the wells 414 of the gel card 410, and therefore across from each of the cover portions.

Each stud 130 has an idle position, as well as a working position in which said stud is made to bear against a cover portion, i.e., here bearing against the upper wall 412*a* of the body 412 of the gel card 410.

As will be seen below, the studs are heated beforehand before being brought into the working position.

In the example of FIG. 7, the heating studs $\mathbf{130}_1$, $\mathbf{130}_3$ and $\mathbf{130}_4$ are positioned vertically along the arrow F3 to be made to bear respectively against cover portions 418*a*, 418*c* and 418*d*.

The heat given off by the heating studs $\mathbf{130}_1$, $\mathbf{130}_3$ and $\mathbf{130}_4$ causes the heat-sealing film or the glue positioned between the cover portions and the upper wall 412*a* of the body of the gel card to melt, following which the cover portions 418*a*, 418*c* and 418*d* come unglued from the gel card. The selected wells $\mathbf{414}_1$, $\mathbf{414}_3$ and $\mathbf{414}_4$ have thus been opened (uncovered).

In this example, the cover portions are removed by bringing the heating studs $\mathbf{130}_1$, $\mathbf{130}_3$ and $\mathbf{130}_4$ back toward their idle position, in other words by moving vertically in the direction symbolized by the arrow F4 (opposite the arrow F3) of FIG. 8. It has been observed that the cover portions are carried away by the studs when the latter rise. However, it is preferable, but not essential, to provide heating studs with means 134 for gripping the cover portions, said means for example being able to assume the form of small claws or tips 134.

After the uncovering operation, it is desirable to discharge the cover portions 418*a*, 418*c* and 418*d* that may have remained attached to the heating studs $\mathbf{130}_1$, $\mathbf{130}_3$ and $\mathbf{130}_4$. To that end, the station according to the invention includes several discharge members for expelling the cover portions gripped by the heating stud. In the case at hand, the station includes six discharge members made up of six rods referenced $\mathbf{132}_1$ to $\mathbf{132}_6$. These rods are fixed to the housing 102 and are positioned such that the gripping devices (the studs) slide around said rods. Each heating stud and each rod thus form a single unit, the rod being comprised inside the heating stud. As will be understood using FIGS. 7 and 9, the rods are completely housed in the heating studs when the latter are in their working position, and protrude when the heating studs are brought back to the idle position. Thus, when the heating studs $\mathbf{130}_1$, $\mathbf{130}_3$ and $\mathbf{130}_4$ rise, the rods $\mathbf{132}_1$, $\mathbf{132}_3$ and $\mathbf{132}_4$ expel the cover portions 418*a*, 418*c* and 418*d* which, in this example, next fall into a collection tub 133.

After the uncovering operation, the tray 108 is moved so as to bring the gel card 410 near means 140 for verifying whether the selected wells $\mathbf{414}_1$, $\mathbf{414}_3$ and $\mathbf{414}_4$ have been correctly opened. In this example, shown in FIG. 10, these means are made up of a set of optical sensors that are arranged to be positioned above the upper wall. These sensors are capable of detecting the absence of metal cover portions and therefore the opening of the selected wells. It is, however, possible to provide non-optical verification means.

Furthermore, the station includes at least one ionizer 150 for ionizing the selected wells, after they are opened, in order to eliminate the electrostatic charges that may be contained in the wells.

In reference now to FIGS. 11 to 13, an embodiment of the selection mechanism 200 according to the invention will be described that makes it possible to select the gripping devices (studs) 130 needing to be moved to their working position, as well as the movement device 300 making it possible to move the gripping devices (studs) 130 between their idle position and their working position.

Figure 11:
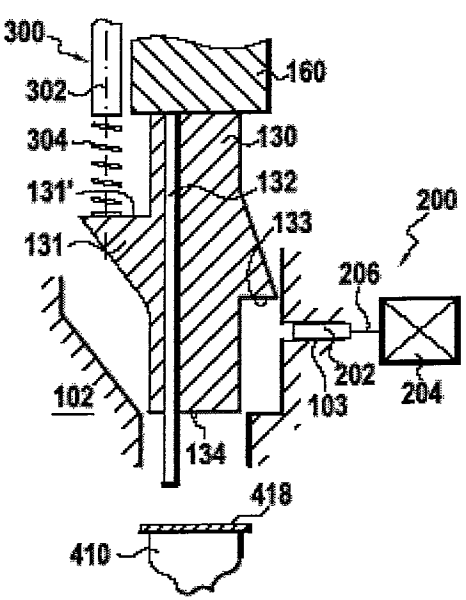
FIG. 11 is a cross-sectional view of one of the gripping devices in the idle position.

FIG. 11 shows one of the heating studs 130 in the idle position, according to a view in a vertical cutting plane parallel to the direction of movement of the tray 108.

In the idle position, the heating stud 130 is in contact with a heating baseplate 160 that is fixed to the housing 102. This heating baseplate for example includes electrical resistances making it possible to keep it at a substantially constant temperature.

In this example, the heating step 130 therefore does not include internal heating means. In other words, the heating stud 130 captures the heat energy when it is in the idle position.

The heating baseplate 160 is configured such that the heating stud can be brought quickly to a temperature of approximately 200° C. To that end, the heating stud will preferably be made from a material such as bronze, or any other material that is a good conductor while having a good friction coefficient.

As already mentioned above, the heating stud 130 (130$_1$, 130$_2$) is mounted sliding around the rod 132 (132$_1$, 132$_2$), the latter being fixed to the frame 102 and, in this example, to the heating baseplate 160.

This stud 130 is moved vertically using the movement device 300, which includes a vertically movable plate 302, the lower end of which bears a compression spring 304. The latter exerts pressure against a horizontal bearing surface 131' (131'$_1$, 131'$_2$) belonging to a radial extension 131 (131$_1$, 131$_2$) of the heating stud 130.

Figure 12:
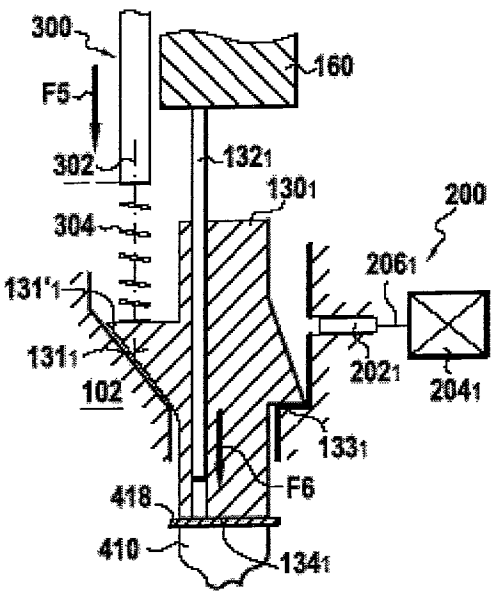
FIG. 12 is a cross-sectional view of one of the gripping devices in the working position.

When the vertical axis of the plate 302 is moved vertically toward the gel card, which is symbolized by the arrow F5 in FIG. 12, the spring 304 exerts pressure on the bearing surface 131', which results in vertically moving this stud toward the gel card 410, in the direction indicated by the arrow F6, in order to bring it into its working position in which it is in contact with the cover portion 418.

The selection mechanism includes several fingers 202 (202$_1$, 202$_2$) that are transversely movable relative to the direction of movement of the studs 130, between a retracted position and a deployed position. More specifically, in this example, there are as many moving fingers as there are heating studs.

Figure 13:
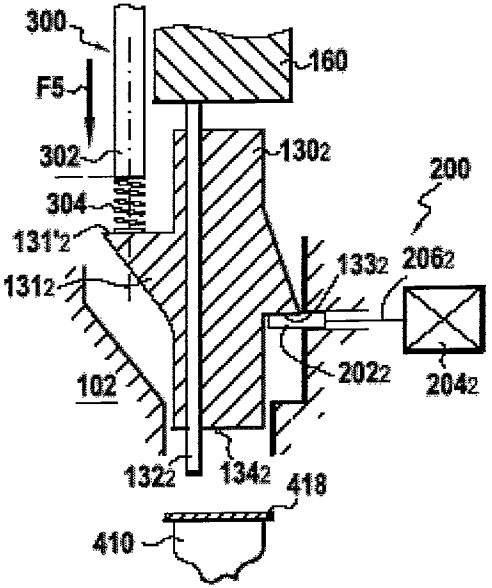
FIG. 13 is a cross-sectional view of one of the gripping devices, the movement of which has not been allowed by the selection mechanism.

FIGS. 11 to 13 show that the movement of the fingers 202 (202$_1$, 202$_2$), in this case a horizontal translation, is done using an electromagnet 204 (204$_1$, 204$_2$) connected to the finger using a rod 206 (206$_1$, 206$_2$).

The stud 130 includes a horizontal stop surface 133 (133$_1$, 133$_2$) designed to cooperate with the finger 202 (202$_1$, 202$_2$) when the latter is in its deployed position, as shown in FIG. 13.

Thus, when the finger is in the retracted position, as is the case in FIG. 12, the stud 130$_1$, which is then a selected stud, may be brought into the working position by vertical movement of the plate 302, the finger 202$_1$ not opposing the movement of said stud.

However, when the finger 202$_2$ is in the deployed position, as is the case in FIG. 13, the stop surface 133$_2$ of the stud 130$_2$ comes in contact with the finger 202$_2$ during movement of the plate 302. This results in blocking the movement of the stud 130$_2$, which is therefore not selected, and subsequently preventing it from being brought into the working position.

In the example of FIGS. 11 to 13, the movement of the plate 302 causes simultaneous movement of all of the studs during the uncovering operation. However, only the studs for which the associated finger is in the retracted position (the selected studs) are brought into the working position. In other words, it is understood that the selection mechanism makes it possible to prevent the movement of the studs that are not selected.

It will therefore be understood that the invention allows selective opening of the wells of the gel card, automatically.

The embodiments or example embodiments described in the present description are provided as an illustration and non-limitingly, one skilled in the art easily being able, in light of this description, to modify these embodiments or examples, or to consider others, while remaining within the scope of the invention.

Furthermore, the different features of these embodiments or examples may be used alone or in combination with each other. When they are combined, these features may be combined as described above or differently, the invention not being limited to the specific combinations described in this description. In particular, unless otherwise specified, a feature described in relation with one embodiment or example may be applied similarly to another embodiment or example.

The invention claimed is:

1. An apparatus for removing a cover from one or more wells of a plurality of wells of a gel card, the apparatus comprising:

an intake tray including a recess for receiving the gel card, the gel card including a body including the plurality of wells, and a cover having a length and a width, wherein the cover is configured to seal the one or more wells of the plurality of wells, wherein the cover has at least one precut, which is between two adjacent wells of the plurality of wells, that forms at least two cover portions, each cover portion of the at least two cover portions sealing at least one well of the plurality of wells of the body;

a plurality of studs, wherein each stud corresponds to a cover portion of the at least two cover portions, and is configured to move independently from other studs of the plurality of studs, and wherein each stud is further configured to move from an idle position, in which the stud is heated, to a working position, in which a heated stud is made to bear against a respective cover portion of the at least two cover portions; and a heating device configured to heat the plurality of studs when a stud of the plurality of studs is in the idle position.

2. The apparatus according to claim 1, further comprising:

a plurality of selection devices, each selection device corresponding to a stud of the plurality of studs and configured to inhibit a respective stud from moving to the working position from the idle position; and a plurality of movement devices, each movement device corresponding to a stud of the plurality of studs and configured to move a respective stud from the idle position to the working position.

3. The apparatus according to claim 2, wherein each movement device of the plurality of movement devices includes a plate coupled to a respective stud with a spring configured to exert a pressure force on the stud.

4. The apparatus according to claim 1, wherein the heating device is a fixed heating baseplate, and wherein each stud of the plurality of the studs is in contact with the fixed heating baseplate when the respective stud is in the idle position.

5. The apparatus according to claim 1, wherein each stud includes a gripping device that grips a cover portion of the at least two cover portions, and wherein the apparatus further comprises:

a plurality of discharge members, wherein each discharge member corresponds to a stud of the plurality of studs and is configured to expel a cover portion gripped by the respective gripping device of the stud.

6. The apparatus according to claim 5, wherein each discharge member of the plurality of discharge members includes a rod, wherein each stud of the plurality of studs surrounds the respective rod and is configured to expel the cover portion when the stud is returned to the idle position from the working position.

7. A biological sample analysis installation including an apparatus according to claim 1.

8. The apparatus according to claim 3, wherein each stud of the plurality of studs moves vertically when moving from the idle position to the working position.

9. The apparatus according to claim 6, wherein each rod is stationary.

10. The apparatus according to claim 1, wherein the at least one precut is a continuous notch extending over at least part of the width of the cover.

11. The apparatus according to claim 1, wherein the at least one precut is a broken notch extending over at least part of the width of the cover.

12. The apparatus according to claim 1, wherein at least one of the cover portions further includes at least one tongue extending transversely relative to the length of the cover.

13. A method for uncovering one or more wells of a plurality of wells of a gel card that comprises a body including the plurality wells, and a cover, having a length and a width, sealing the plurality of wells, wherein the cover has at least one precut, which is between two adjacent wells of the plurality of wells, to form at least two cover portions, each cover portion of the at least two cover portions sealing at least one well of the plurality of wells of the body, the method comprising:

heating at least one cover portion with a heated stud to release the least one cover portion from the body of the gel card;

adhering the at least one cover portion to the heated stud; and moving the heated stud away from the body of the gel card, wherein moving the heated stud removes the at least one cover portion from the body of the gel card.

* * * * *